US005397689A

United States Patent [19]

Ohki et al.

[11] Patent Number: 5,397,689

[45] Date of Patent: Mar. 14, 1995

[54] SILVER HALIDE PHOTOGRAPHIC MATERIAL

[75] Inventors: Nobutaka Ohki; Naoki Asanuma; Osamu Takahashi; Shigeo Hirano, all of Minami-ashigara, Japan

[73] Assignee: Fuji Photo Film Co., Ltd., Kanagawa, Japan

[21] Appl. No.: 95,180

[22] Filed: Jul. 23, 1993

[30] Foreign Application Priority Data

Jul. 28, 1992 [JP] Japan ..... 4-219582

[51] Int. Cl.[6] ..... G03C 1/46

[52] U.S. Cl. ..... 430/504; 430/551; 430/607

[58] Field of Search ..... 430/551, 372, 504, 607

[56] References Cited

U.S. PATENT DOCUMENTS

| | | | |
|---|---|---|---|
| 4,430,425 | 2/1984 | Leppard | 430/551 |
| 4,484,000 | 11/1984 | Howell | 560/75 |
| 4,608,435 | 8/1986 | Howell | 544/87 |
| 5,006,454 | 4/1991 | Sasaki et al. | 430/551 |

FOREIGN PATENT DOCUMENTS

| | | |
|---|---|---|
| 59-189342 | 10/1984 | Japan . |
| 61-13748 | 4/1986 | Japan . |
| 2-29739 | 1/1990 | Japan . |
| 3-175441 | 7/1991 | Japan . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide photographic material is disclosed which comprises a support having thereon at least one layer containing at least one member of compounds represented by the following general formula (1) or (2):

(1)

(2)

wherein L represents an unsubstituted alkylene group; X represents —O(C=O)$R_2$, —O(P=O) ($R_2$) ($R_3$) or a halogen atom; $R_1$ represents a substituent group; $R_2$ and $R_3$ each represents a substituted or unsubstituted alkoxy group, a substituted or unsubstituted aryloxy group or a substituted or unsubstituted amino group; n represents 0, 1 or 2 and when n is 2, two $R_1$ groups may be the same or different; $R_4$ represents an unsubstituted alkyl group having 2 to 20 carbon atoms; and $R_5$ represents an unsubstituted alkyl group, the number of carbon atoms of which is larger by 2 than the number of carbon atoms of $R_4$.

16 Claims, No Drawings

SILVER HALIDE PHOTOGRAPHIC MATERIAL

FIELD OF THE INVENTION

This invention relates to a silver halide photographic material having improved properties with regard to the inhibition of color mixing and the fading of the dye image.

BACKGROUND OF THE INVENTION

There are known methods wherein silver halide color photographic materials are processed with color developing solutions containing aromatic primary amine developing agents after exposure to light to form a color image. It is known that in the above-described color image forming methods, the developing agents are oxidized by oxygen in air, and the oxidants of the developing agents are reacted with color couplers in the unexposed area or low-exposed area of the photographic material to form a dye and as a result, color fogging is caused. It is also known that when conventional color photographic materials containing color couplers having different color sensitivity and forming different hues are processed, the oxidant of the developing agent formed in a color-sensitive layer is diffused in another color-sensitive layer and reacted with color couplers and as a result, color contamination (color mixing) occurs.

JP-B-61-13748 (the term "JP-B" as used herein means an "examined Japanese patent publication") and U.S. Pat. No. 4,430,425 propose a method using hydroquinone compounds as means for preventing the undesired color fogging and color contamination from occurring.

These compounds have certainly an effect of preventing the above-described color fogging or color contamination from occurring. However, the effect obtained thereby is low, and there are disadvantages that solubility is low and preservability is poor. Accordingly, it has been demanded to provide hydroquinone compounds which are free from the above disadvantages and have excellent performance on the whole.

SUMMARY OF THE INVENTION

An object of the present invention is to provide a silver halide photographic material having improved properties with regard to color fogging and color contamination (color mixing).

Another object of the present invention is to provide a silver halide photographic material containing a hydroquinone compound having improved solubility and preservability.

The above-described objects of the present invention have been achieved by providing a silver halide photographic material comprising a support having thereon at least one layer containing at least one member of compounds represented by the following general formula (1) or (2):

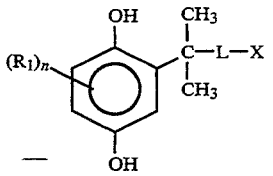

(1)

-continued

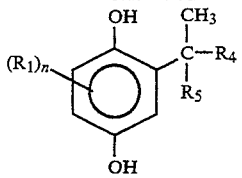

(2)

wherein L represents an unsubstituted alkylene group; X represents $-O(C{=}O)R_2$, $-O(P{=}O)(R_2)(R_3)$ or a halogen atom; $R_1$ represents a substituent group; $R_2$ and $R_3$ each represents a substituted or unsubstituted alkoxy group, a substituted or unsubstituted aryloxy group or a substituted or unsubstituted amino group; n represents 0, 1 or 2 and when n is 2, two $R_1$ groups may be the same or different; $R_4$ represents an unsubstituted alkyl group having 2 to 20 carbon atoms; and $R_5$ represents an unsubstituted alkyl group, the number of carbon atoms of which is larger by 2 than the number of carbon atoms of $R_4$.

DETAILED DESCRIPTION OF THE INVENTION

The compounds of general formulas (1) and (2) will be described in more detail below.

L represents an alkylene group (e.g., having 1 to 20 carbon atoms, such as ethylene, butylene, hexylene, propylene, 2-methylhexylene).

$R_1$ represents a substituent group. Examples of the substituent group represented by $R_1$ include a cyano group, a nitro group, a hydroxy group, a carboxyl group, a sulfo group, an alkyl group preferably having 1 to 40 carbon atoms, more preferably 2 to 30 carbon atoms, still more preferably not more than 20 carbon atoms, (e.g., a primary, secondary or tertiary alkyl group such as methyl, ethyl, t-butyl, t-octyl, hexadecyl, 1-ethyl-1-methylpentyl, 1-hexyl-1-methylnonyl), an alkoxy group preferably having 1 to 40 carbon atoms, more preferably 1 to 30 carbon atoms (e.g., methoxy, butoxy), an aryloxy group preferably having 6 to 40 carbon atoms, more preferably 6 to 30 carbon atoms (e.g., phenoxy), an alkylthio group preferably having 1 to 40 carbon atoms, more preferably 1 to 30 carbon atoms (e.g., methylthio, butylthio), an arylthio group preferably having 6 to 40 carbon atoms, more preferably 6 to 30 carbon atoms (e.g., phenylthio), an alkyl, aryl, or heterocyclic acylamino group preferably having 2 to 40 carbon atoms, more preferably 2 to 30 carbon atoms (e.g., acetylamino, benzoylamino), an alkyl, aryl, or heterocyclic sulfonamido group preferably having 1 to 40 carbon atoms, more preferably 1 to 30 carbon atoms (e.g., methanesulfonamido, benzenesulfonamido), a ureido group preferably having 0 to 40 carbon atoms, more preferably 1 to 30 carbon atoms (e.g., butylureido, dodecylureido), a heterocyclic thio group preferably having 1 to 40 carbon atoms, more preferably 2 to 30 carbon atoms, and further more preferably 2 to 20 (e.g., 1-phenyltetrazolylthio group), an alkyl, aryl, or heterocyclic acyl group preferably having 2 to 40 carbon atoms, more preferably 2 to 30 carbon atoms (e.g., acetyl), an alkyl, aryl, or heterocyclic sulfonyl group preferably having 1 to 40 carbon atoms, more preferably 1 to 30 carbon atoms (e.g., benzenesulfonyl) and groups described below in the definition of X. These substituent groups may be further substituted by those described above. Of these groups, the preferred carbon atom numbers mean the total carbon numbers of the groups including the substituents. Preferably, $R_1$ is a halogen atom, a sulfo group, an alkyl group, an acylamino group or a sulfonamido group.

The heterocyclic moiety as used herein means a 5-membered to 7-membered ring, preferably a 5-membered or 6-membered ring, and having at least one hetero atom selected from the group consisting of N, O, and S.

In the above formulas, n represents 0, 1 or 2. Preferably, n is 1.

X represents $—O(C{=}O)R_2$, $—O(P{=}O)(R_2)(R_3)$ or a halogen atom (e.g., fluorine, bromine, chlorine). Preferably, X is $—O(C{=}O)R_2$.

$R_2$ and $R_3$ each represents a substituted or unsubstituted alkoxy group (e.g., having 1 to 20 carbon atoms, such as methoxy, butoxy, hexadecyloxy), a substituted or unsubstituted aryloxy group (e.g., having 6 to 20 carbon-atoms, such as phenoxy, 4-t-octylphenoxy) or a substituted or unsubstituted amino group (e.g., having 0 to 20 carbon atoms, such as N,N-dimethylamino, N-hexadecylamino, N,N-dipropylamino). These groups represented by $R_2$ and $R_3$ may be substituted. Examples of substituent groups include those already described above in the definition of $R_1$.

$R_4$ represents an unsubstituted alkyl group having 2 to 20 carbon atoms. $R_5$ represents an unsubstituted alkyl group, the number of carbon atoms of which is larger by 2 than the number of carbon atoms of $R_4$. The unsubstituted alkyl group represented by $R_4$ and $R_5$ may be a straight-chain alkyl group or a branched alkyl group. $R_4$ preferably has 2 to 13 carbon atoms, more preferably 4 to 8 carbon atoms. Examples of the alkyl group represented by $R_4$ and $R_5$ include an ethyl group, butyl group, hexyl group, octyl group, decyl group, dodecyl group, tetradecyl group, hexadecyl group, 1,3,3-trimethylbutyl group, 3,5,5-trimethylhexyl group and octadecyl group.

Among the compounds of general formula (1) or (2), compounds represented by the following general formula (1a) or (2a) are preferred.

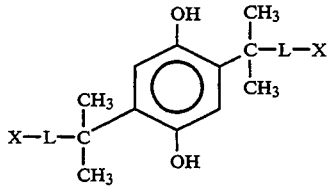

(1a)

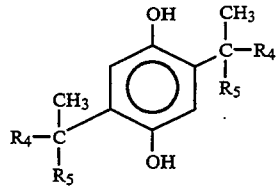

(2a)

wherein L, X, $R_4$ and $R_5$ are as defined above in general formulas (1) and (2).

Specific examples of the hydroquinone derivatives of general formulas (1) and (2) include, but are not limited to, the following compounds.

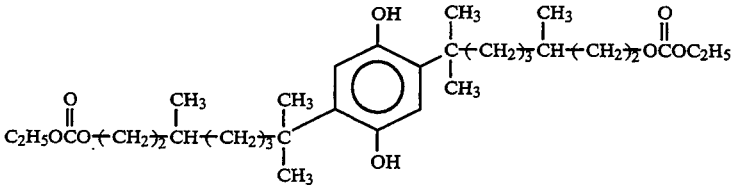

(I-1)

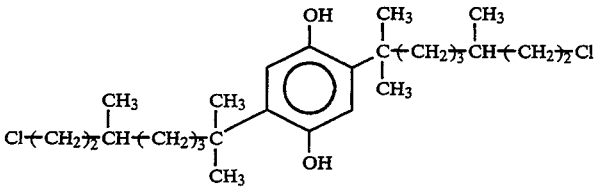

(I-2)

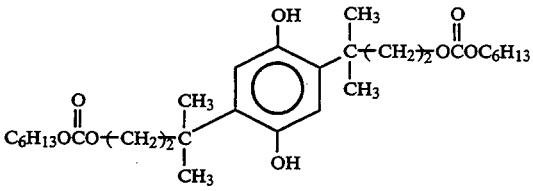

(I-3)

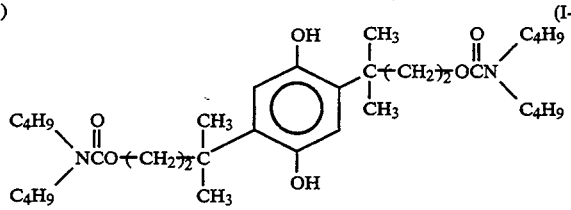

(I-4)

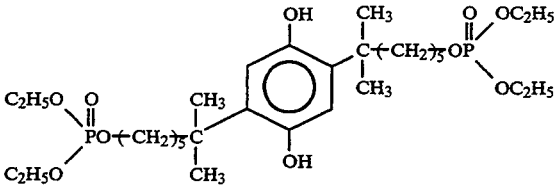

(I-5)

-continued
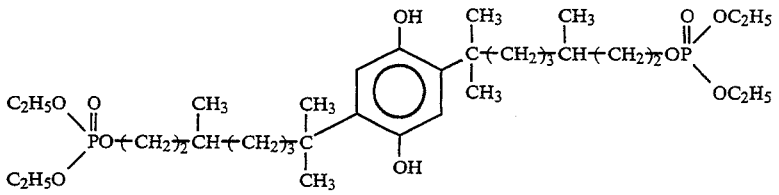
(I-6)
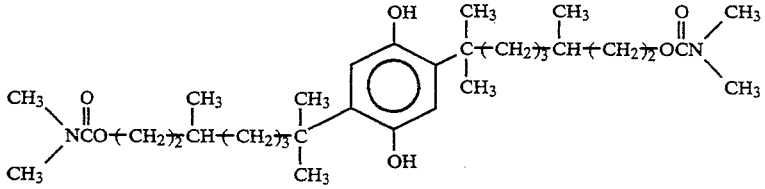
(I-7)
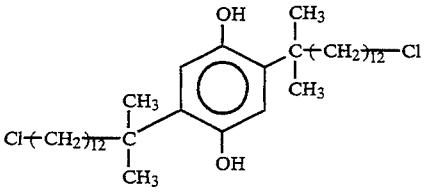
(I-8)
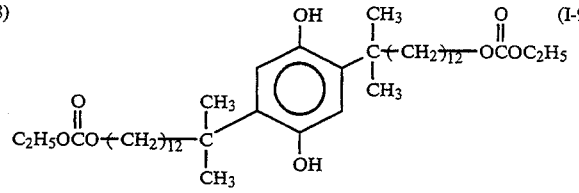
(I-9)
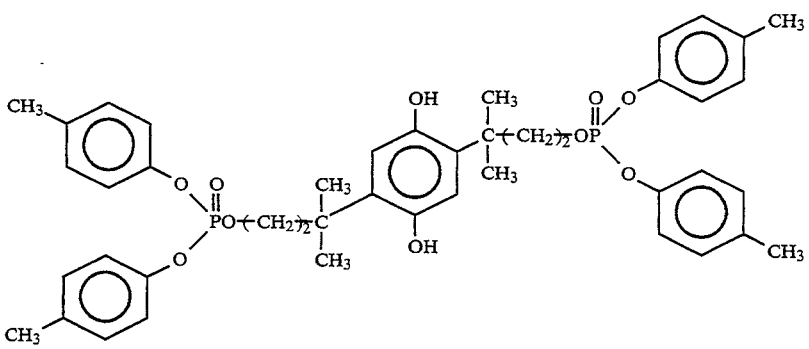
(I-10)
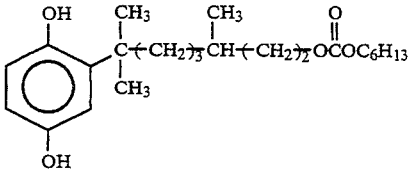
(I-11)
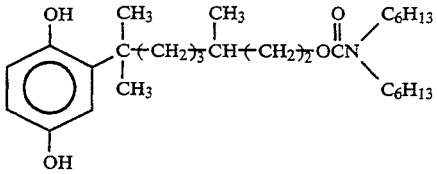
(I-12)
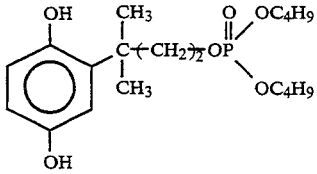
(I-13)
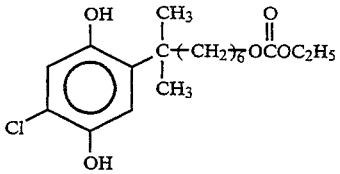
(I-14)
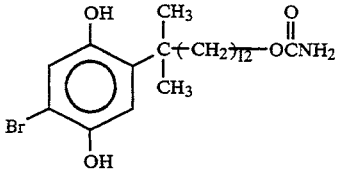
(I-15)
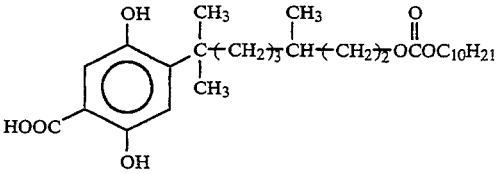
(I-16)
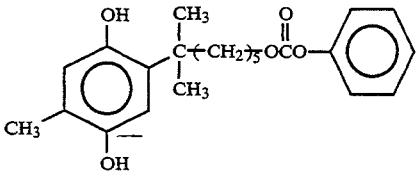
(I-17)
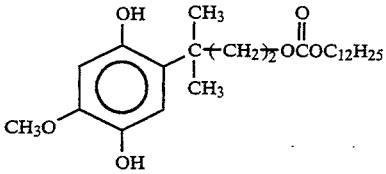
(I-18)

-continued
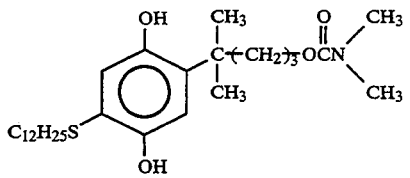
(I-19)
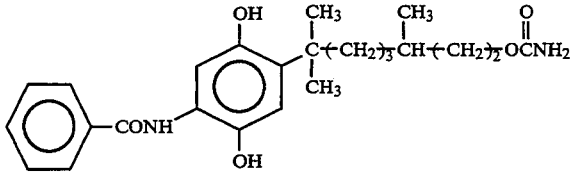
(I-20)
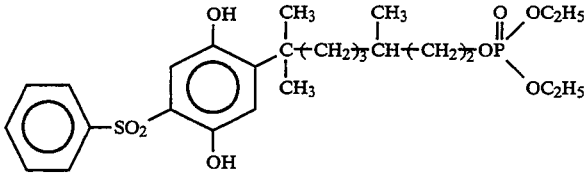
(I-21)
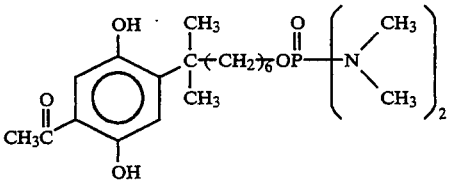
(I-22)
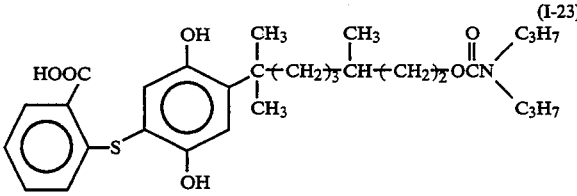
(I-23)
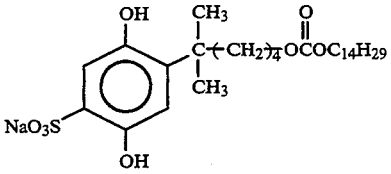
(I-24)
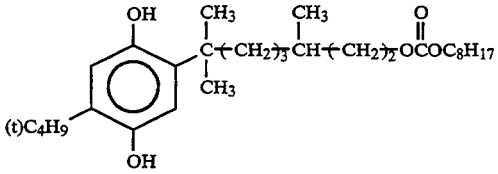
(I-25)
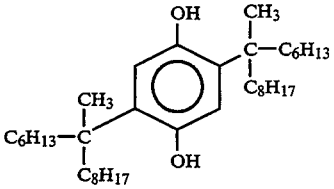
(II-1)
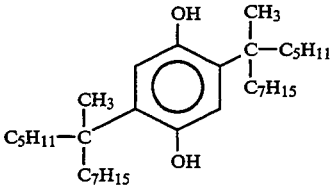
(II-2)
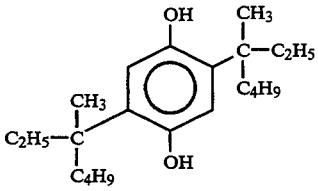
(II-3)
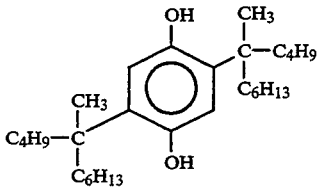
(II-4)
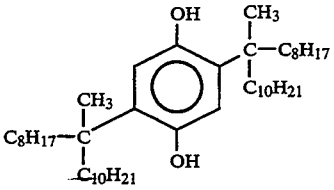
(II-5)
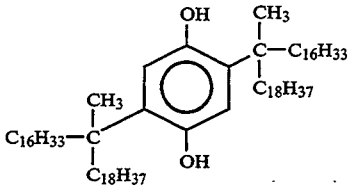
(II-6)

-continued
(II-7)
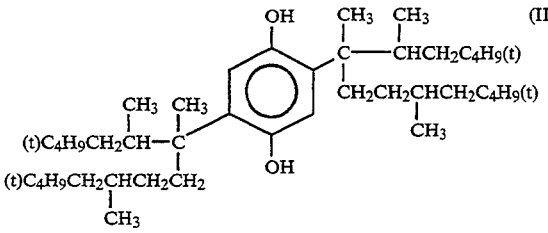
(II-8)
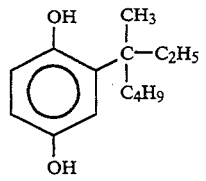
(II-9)
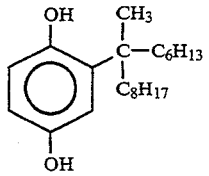
(II-10)
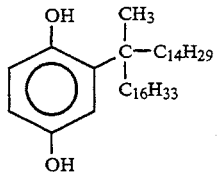
(II-11)
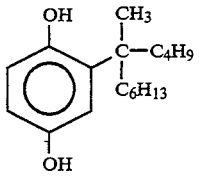
(II-12)
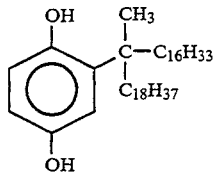
(II-13)
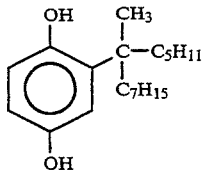
(II-14)
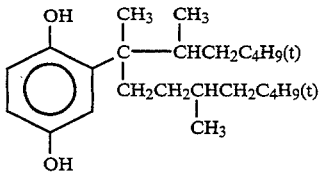
(II-15)
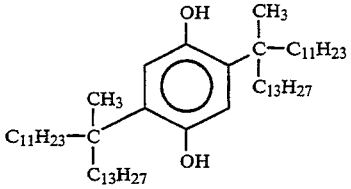
(II-16)
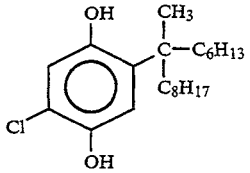
(II-17)
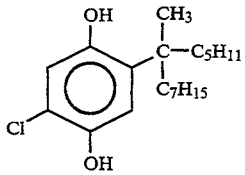
(II-18)
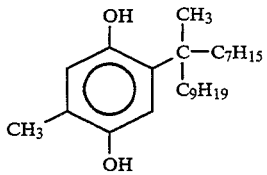
(II-19)
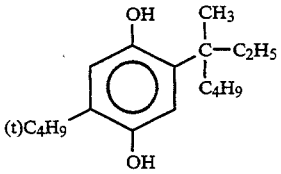
(II-20)
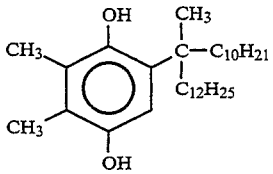
(II-21)
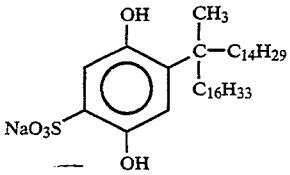
(II-22)
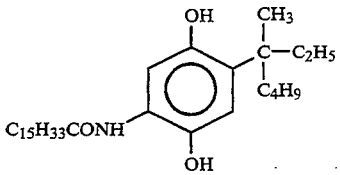

-continued (II-23)

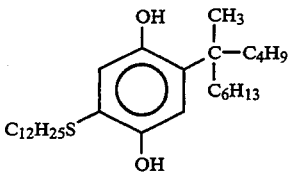

(II-24)

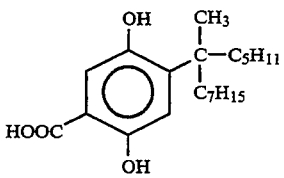

(II-25)

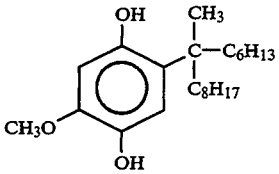

(II-26)

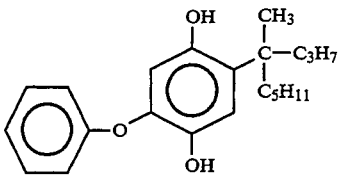

(II-27)

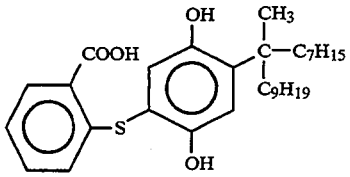

(II-28)

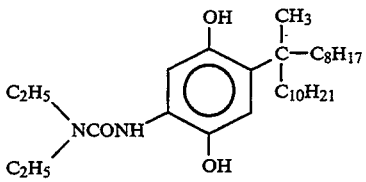

(II-29)

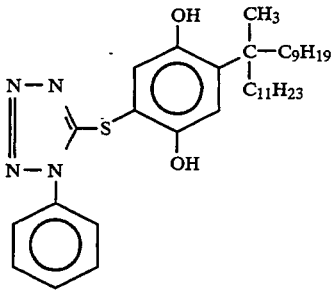

(II-30)

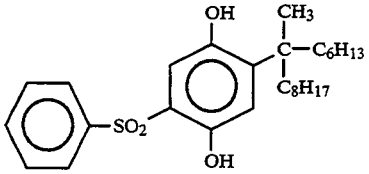

Of these, (I-1), (I-2), (II-1) and (II-5) are preferable.

The compounds of general formulas (1) and (2) according to the present invention can be synthesized by referring to the method described in U.S. Pat. No. 4,430,425 and JP-B-61-13748. Specific synthesis examples thereof are shown below.

Synthesis Example 1

To 150 ml of acetonitrile, there were added 78.1 g of citronellol and 41 g of pyridine. While stirring the mixture under cooling with ice, 55 g of ethyl chloroformate were added dropwise thereto over a period of 30 minutes. As the reaction proceeded, a salt was precipitated. After completion of the dropwise addition, the reaction mixture was stirred for an additional one hour and then extracted with ethyl acetate and water. The organic layer was washed with water twice, dried over magnesium sulfate and concentrated to obtain 105 g of a colorless liquid. NMR data showed that the liquid was 2,6-dimethyl-8-ethoxycarbonyloxy-2-octene.

To 30 ml of ethyl acetate, there were added 5.5 g of hydroquinone and 10 ml of concentrated sulfuric acid at a bulk temperature of not higher than 30° C. While stirring the mixture, 24 g of the liquid olefin prepared above were added dropwise thereto over a period of one hour. After completion of the dropwise addition, the bulk temperature was raised to 40° C., and the mixture was continuously stirred for 3 hours. After the reaction mixture was allowed to stand to cool it, 30 ml of each of hexane and water were added thereto to separate it into two portions. The organic layer was washed with water three times, dried over magnesium sulfate and concentrated to obtain 28 g of a brown oily product. The product was purified by means of column chromatography to obtain 23 g of a light brown oil. The NMR data and elemental analysis of the crystal obtained from the oil showed that the product was compound (I-1).

Synthesis Example 2

To 30 ml of ethyl acetate, there were added 5.5 g of hydroquinone and 10 ml of concentrated sulfuric acid at a bulk temperature of not higher than 30° C. While stirring the mixture, 24 g of 2-hexyl-1-decene were added dropwise thereto over a period of one hour. After completion of the dropwise addition, the bulk temperature was raised to 40° C., and the mixture was continuously stirred for 3 hours. After the reaction mixture was allowed to stand to cool it, 30 ml of each of hexane and water were added thereto to separate it into two portions. The organic layer was washed with water three times, dried over magnesium sulfate and concentrated to obtain 29 g of a brown oily product. The product was purified by means of column chromatography and recrystallized from hexane to obtain 17 g of a white crystal with a melting point of 62° to 64° C. The NMR data and elemental analysis of the crystal showed that the product was compound (II-1).

The compounds of general formula (2) are preferable in the present invention.

The color photographic materials of the present invention may comprise a support having thereon at least one layer containing at least one member of the compounds of general formula (1) or (2) according to the present invention (hereinafter referred to as compounds of the present invention). The layer containing at least one member of the compounds of the present invention may be any of hydrophilic colloid layers. With regard to other layers and the layer structure, the color photographic materials of the present invention may have any layers in any order. However, it is preferred that the color photographic materials of the present invention have a yellow color forming silver halide emulsion layer, a magenta color forming silver halide emulsion layer, a cyan color forming silver halide emulsion layer, protective layers, interlayers and a back layer, and the silver halide emulsion layers are a blue-sensitive layer, a green-sensitive layer and a red-sensitive layer. The silver halide emulsion layers of the photographic materials of the present invention can be coated in the above-described order. However, the silver halide emulsion layers may be coated in a different order from that described above. Further, an infrared-sensitive silver halide emulsion layer may be used in place of at least one of the above-described sensitive emulsion layers.

The compounds of the present invention may be added to any of the silver halide emulsion layers, the interlayers (e.g., a color mixing inhibiting layer, an ultraviolet light absorbing layer), the protective layers and the back layer. However, it is preferred that the compounds of the present invention are added to at least one layer of the silver halide emulsion layers and the interlayers adjacent thereto. It is more preferred that the compounds of the present invention are added to at least one layer of the light-insensitive interlayers.

The compounds of the present invention are used in an amount of $1\times10^{-8}$ to $1\times10^{-2}$ mol/m$^2$, preferably $1\times10^{-7}$ to $1\times10^{-3}$ mol/m$^2$, most preferably $1\times10^{-6}$ to $1\times10^{-4}$ mol/m$^2$ in total.

Various color couplers can be used in the present invention. Examples of the color couplers which can be used in the present invention include conventional color couplers described in patent specifications cited in *Research Disclosure* (RD) No. 17463, Item VII-C to G and ibid. No. 307105, Item VII-C to G, JP-A-62-215272 (the term "JP-A" as used herein means an "unexamined published Japanese patent application"), JP-A-3-33847 and JP-A-2-33144.

Yellow couplers described in U.S. Pat. Nos. 3,933,501, 4,022,620, 4,326,024, 4,401,752 and 4,248,961, JP-B-58-10739, U.K. Patents 1,425,020 and 1,426,760, U.S. Pat. Nos. 3,973,968, 4,314,023, 4,511,649 and 5,118,599, European Patents 249,473A and 0,447,969, JP-A-63-23145, JP-A-63-123047, JP-A-1-250944 and JP-A-1-213648 can be used in the present invention, so long as they do not have an adverse effect on the compounds of the present invention. Examples of yellow couplers which can be particularly preferably used in the present invention include those represented by general formula (Y) described in JP-A-2-139544 (left upper column of page 18 to left lower column of page 22), acylacetamide yellow couplers characterized by an acyl group described in JP-A-5-2248 and European Patent Laid-Open No. 0447,969 and yellow couplers represented by general formula (Cp-2) described in JP-A-5-27389 and European Patent Laid-Open No. 0446,863A2.

Magenta couplers which can be preferably used include 5-pyrazolone compounds and pyrazoloazole compounds. Magenta couplers described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630 and (PCT) WO 88/04795 are more preferred.

Magenta couplers which can be particularly preferably used include pyrazoloazole magenta couplers of general formula (I) described in JP-A-2-139544 (right lower column of page 3 to right lower column of page 10) and 5-pyrazolone magenta couplers of general formula (M-I) described in JP-A-2-139544 (left lower column of page 17 to left upper column of page 21). Most preferred are the pyrazoloazole magenta couplers.

Cyan couplers include phenol cyan couplers and naphthol cyan couplers. Cyan couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-Open No. 3,329,729, European Patents 0,121,365A and 0,249,453A, U.S. Pat. Nos. 3,446,622, 4,333,999, 4,775,616, 4,451,559, 4,427,767, 4,690,889, 4,254,212 and 4,296,199 and JP-A-61-42658 are preferred. Further, pyrazoloazole couplers described in JP-A-64-553, JP-A-64-554, JP-A-64-555 and JP-A-64-556, pyrrolotriazole couplers described in European Patent Laid-Open Nos. 0,488,248 and 0,491,197, pyrroloimidazole couplers described in European Patent Laid-Open No. 0,456,226A, pyrazotopyrimidine couplers described in JP-A-64-46753, imidazole couplers described in U.S. Pat. Nos. 4,818,672 and JP-A-2-33144, cyclic active methylene type cyan couplers described in JP-A-64-32260 and couplers described in JP-A-1-183658, JP-A-2-262655, JP-A-2-85851 and JP-A-3-48243 can be used.

Typical examples of dye forming polymer couplers are described in U.S. Pat. Nos. 3,451,820, 4,080,211, 4,367,282, 4,409,320 and 4,576,910, U.K. Patent 2,102,137 and European Patent 341,188A. Preferred examples of couplers whose developed dyes have proper diffusibility are described in U.S. Pat. No. 4,366,237, U.K. Patent 2,125,570, European Patent 96,570 and West German Patent Laid-Open No. 3,234,533. Preferred examples of colored couplers for correcting unwanted absorption of developed dyes are described in *Research Disclosure* No. 17643, item VII-G, ibid. No. 307105, Item VIII-G, U.S. Pat. No. 4,163,670, JP-B-57-39413, U.S. Pat. Nos. 4,004,929 and 4,138,258 and U.K. Patent 1,146,368. Further, couplers for correcting unwanted absorption of developed dyes by a fluorescent dye released during coupling, described in U.S. Pat. No. 4,774,181 and couplers having a dye precursor group, as an eliminable group, capable of forming a dye by the reaction with a developing agent, described in U.S. Pat. No. 4,777,120 can be preferably used.

Compounds which release a photographically useful residue-by coupling can be preferably used in the present invention. Preferred examples of DIR couplers which release a restrainer are described in patent specifications cited in RD No. 17643, Item VII-F and RD No. 307105, JP-A-57-151944, JP-A-57-154234, JP-A-60-184248, JP-A-63-37346, JP-A-63-37350 and U.S. Pat. Nos. 4,248,962 and 4,782,012.

Bleaching accelerator-releasing couplers described in RD No. 11449, RD No. 24241 and JP-A-61-201247 are effective in shortening the processing time in the processing stage having an ability of bleaching. Particularly, when the couplers are used in photographic materials containing tabular silver halide grains, the effect thereof is remarkable. Preferred examples of couplers which release imagewise a nucleating agent or a development accelerator during development include those described in U.K. Pat. Nos. 2,097,140 and 2,131,188, JP-A-59-157638 and JP-A-59-170840. Further, compounds which release a fogging agent, a development accelerator, a solvent for silver halide, etc. by the redox reaction with the oxidants of the developing agents, described in JP-A-60-107029, JP-A-60-252340, JP-A-1-44940 and JP-A-1-45867 can be preferably used.

Examples of other compounds which can be used in the photographic materials of the present invention include competitive couplers described in U.S. Pat. No. 4,130,427; polyequivalent type couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing couplers described in JP-A-60-185950 and JP-A-62-24252; couplers which release a dye whose color is restored to the original color after elimination described in European Pat. Nos. 173,302A and 313,308A; ligand-releasing couplers described in U.S. Pat. No. 4,555,477; leuco dye-releasing couplers described in JP-A-63-75747; and fluorescent dye releasing couplers described in U.S. Pat. No. 4,774,181.

These colored couplers are generally used in an amount of 0.001 to 1 mol per mol of sensitive silver halide in the present invention. The yellow couplers are used in an amount of preferably 0.01 to 0.5 mol per mol of silver halide. The magenta couplers are used in an amount of preferably 0.003 to 0.3 mol per mol of silver halide. The cyan couplers are used in an amount of preferably 0.002 to 0.3 mol per mol of silver halide.

The photographic materials prepared by the present invention may contain hydroquinone derivatives, aminophenol derivatives, gallic acid derivatives and ascorbic acid derivatives as color fogging inhibitors (antifogging agents).

The photographic materials of the present invention may contain various anti-fading agents. Examples of the organic anti-fading agents for cyan, magenta and/or yellow images include hydroquinones, 6-hydroxychromans, 5-hydroxycoumarans, spiro-chromans, hindered phenols such as bisphenols and p-alkoxyphenols, gallic acid derivatives, methylenedioxybenzenes, aminophenols, hindered amines and ethers or ester derivatives obtained by silylating or alkylating phenolic hydroxyl group of the above-described compounds. Further, metal complexes such as (bissalicyl-aldoximato)nickel complex and (bis-N,N-dialkyldithiocarbamato)nickel can also be used.

Examples of the organic anti-fading agents includes hydroquinones described in U.S. Pat. Nos. 2,360,290, 2,418,613, 2,700,453, 2,701,197, 2,728,659, 2,732,300, 2,735,765, 3,982,944 and 4,430,425, U.K. Patent 1,363,921, U.S. Pat. Nos. 2,710,801 and 2,816,028; 6-hydroxychromans, 5-hydroxycoumarans and spirochromans described in U.S. Pat. Nos. 3,432,300, 3,573,050, 3,574,627, 3,698,909 and 3,764,337 and JP-A-52-152225; spiro-indanes described in U.S. Pat. No. 4,360,589; p-alkoxyphenols described in U.S. Pat. No. 2,735,765, U.K. Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives, methylenedioxybenzenes and aminophenols described in U.S. Pat. Nos. 3,457,079 and 4,332,886 and JP-B-56-21144; hindered amines described in U.S. Pat. Nos. 3,336,135 and 4,268,593, U.K. Pat. Nos. 1,326,889, 1,354,313 and 1,410,846, JP-B-51-1420, JP-A-58-114036, JP-A-59-53846 and JP-A-59-78344; and metal complexes described in U.S. Pat. Nos. 4,050,938 and 4,241,155 and U.K. Patent 2,027,731 (A). These compounds are used in an amount of generally 5 to 100% by weight based on the amount of the corresponding color coupler. These compounds are co-emulsified with the couplers and added to the emulsion layers.

It is more effective that ultraviolet light absorbers are introduced into the cyan color forming layer and layers adjacent thereto to prevent a cyan dye image from being deteriorated by heat and particularly light.

Examples of the ultraviolet light absorbers include aryl group-substituted benztriazole compounds described in U.S. Pat. No. 3,533,794; 4-thiazolidone compounds described in U.S. Pat. Nos. 3,314,794 and 3,352,681; benzophenone compounds described in JP-A-46-2784; succinic ester compounds described in U.S. Pat. Nos. 3,705,805 and 3,707,395; butadiene compounds described in U.S. Pat. No. 4,045,229; and benzoxazole compounds described in U.S. Pat. Nos. 3,406,070, 3,677,672 and 4,271,307. If desired, ultraviolet absorbing couplers (e.g., $\alpha$-naphthol cyan color forming couplers) and ultraviolet light absorbing polymers may be used. These ultraviolet light absorbers may be mordanted in specific layers. Of these compounds, the aryl group-substituted benztriazole compounds are particularly preferred.

It is preferred that the following compounds are used together with the above-described couplers, particularly the pyrazoloazole magenta couplers or the pyrroloazole couplers.

Namely, it is preferred that a compound (F) and/or a compound (G) are/is used together with the couplers, said compound (F) being chemically bonded to the aromatic amine color developing agents left behind after color development to form a compound which is chemically inert and substantially colorless, and said compound (G) being chemically bonded to the oxidants of the aromatic amine color developing agents left behind after color development to form a compound which is chemically inert and substantially colorless. The use of the compound (F) and/or the compound (G) alone or in combination is preferred from the standpoint of preventing stain from being formed by the developed dye produced by the reaction of the couplers with the color developing agents and/or the oxidants thereof left behind in the layers during storage after processing and preventing other side effects from occurring.

The details of the compounds (G) and (F) and the combination thereof are described in European Patent Laid-Open No. 277,589.

The hydrophilic colloid layers of the photographic materials of the present invention may contain water-soluble dyes or dyes which are made water-soluble by photographic processing, as filter dyes or to prevent irradiation or halation. Examples of the dyes include oxonol dyes, hemioxonol dyes, styryl dyes, merocyanine dyes, cyanine dyes and azo dyes. Of these dyes, oxonol dyes, hemioxonol dyes and merocyanine dyes are preferred.

Transparent films such as cellulose nitrate film and polyethylene terephthalate film and reflection type supports which are used for conventional photographic materials can be used as supports in the present invention. For the purpose of the present invention, the reflection type supports are preferable.

Examples of the reflection type supports which can be used in the present invention include polyethylene-coated paper, polypropylene synthetic paper and transparent supports coated with a reflection layer or containing a reflecting material, such as glass sheet, polyester films (e.g., polyethylene terephthalate film, cellulose triacetate film, cellulose nitrate film), polyamide films, polycarbonate films, polystyrene films and vinyl chloride films coated with a reflecting layer or containing a reflecting material.

Any of silver chloride, silver bromide, silver chlorobromide, silver iodochloride, silver iodochlorobromide and silver iodobromide can be used as silver halide in the present invention. Silver chlorobromide having a silver chloride content of at least 90 mol %, more preferably at least 95%, particularly preferably at least 98 mol % and containing substantially no silver iodide or silver chloride containing substantially no silver iodide is preferred from the standpoint of displaying effectively the effect of the present invention and rapid processing.

The photographic materials of the present invention can be processed in a conventional manner. Color developing solutions which are used in the development of the photographic materials after imagewise exposure are preferably aqueous alkaline solutions containing aromatic primary amine color developing agents as principal ingredients. Aminophenol compounds are useful as the color developing agents. However, p-phenylenediamine compounds can be preferably used as the color developing agents. Typical examples of the p-phenylenediamine compounds include 3-methyl-4-amino-N,N-diethylaniline, 3-methyl-4-amino-N-ethyl-N-β-hydroxybutylaniline, 3-methyl-4-amino-N-ethyl-N-β-hydroxybutylaniline, 3-methyl-4-amino-N-ethyl-N-β-hydroxypropylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate. These compounds maybe used in a combination of two or more thereof according to the desired purpose.

The color developing solutions may contain hydroxylamines described in JP-A-63-5341, JP-A-63-106655 and JP-A-4-144446, hydroxamic acids described in JP-A-63-43138, hydrozines and hydrazides described in JP-A-63-146041, phenols described in JP-A-63-44657 and JP-A-63-58443, α-hydroxyketones and α-aminoketones described in JP-A-63-44656, and saccharide described in JP-A-63-36244 as compounds which directly preserve the aromatic primary amine color developing agents. In combination with the above-described compounds, there can be used monoamines described in JP-A-63-4235, JP-A-63-24254, JP-A-63-21647, JP-A-63-146040, JP-A-63-25654; diamines described in JP-A-63-30845, JP-A-63-14640 and J-A-63-43139; polyamines described in JP-A-63-21647 and JP-A-63-26655; nitroxyradicals described in JP-A-63-53551; alcohols described in JP-A-63-43140 and JP-A-63-53549; oximes described in JP-A-63-56654; and tertiary amines described in JP-A-63-239447.

Examples of other preservatives which may be used in the present invention include metals described in JP-A-57-44148 and JP-A-57-53749, salicylic acids described in JP-A-59-180588, alkanolamines described in JP-A-54-3582, polyethyleneimines described in JP-A-56-94349, and aromatic polyhydroxy compounds described in U.S. Pat. No. 3,746, 544.

Particularly preferred preservatives are hydroxylamines of general formula (I) described in JP-A-3-144446. Compounds having a sulfo group or a carboxyl group are particularly preferred.

Further, the color developing solutions may contain various additives described in JP-A-3-144446. Examples of the additives include pH buffering agents such as carbonic acids, phosphoric acids, boric acids and hydroxybenzoic acids (e.g., the 6th line of right upper column of page 9 to the first line of left lower column of page 9 of JP-A-3-144446), chelating agents such as aminopolycarboxylic acids, phosphonic acids and sulfonic acids (e.g., preferably ethylenediaminetetraacetic acid, triethylenetetraminehexaacetic acid, 1,3-diaminopropanoltetraacetic acid, diethylenetriaminepentaacid, ethylenediamine-N,N,N',N'-tetrakis(methylenephosphonic acid) and catechol-3,5-di-sulfonic acid (e.g., the second line of left lower column to the 18th line of right lower column of page 9 of JP-A-3-144446), development accelerators (e.g., the 19th line of left lower column of page 9 to the 7th line of right upper column of page 10 of JP-A-3-144446), and anti-fogging agents such as halide ions and organic anti-fogging agents (e.g., the 8th line of right upper column to the 5th line of left lower column of page 10 of JP-A-3-144446). If desired, surfactants such as alkylsulfonic acids, arylsulfonic acids, aliphatic carboxylic acids, aromatic carboxylic acids may be added.

When the photographic materials are processed with the color developing solutions in automatic processors, it is preferred that the contact area (e.g., opening area) of the color developing solution with air is as small as possible. For example, the opening ratio is preferably 0.01 $cm^{-1}$ or less, more preferably 0.005 $cm^{-1}$ or less when the value obtained by dividing the opening area ($cm^2$) by the volume ($cm^3$) of the developing solution is referred to as the opening ratio.

When reversal processing is conducted, black and white development is first carried out, and color development is then carried out. The black and white developing solutions may contain one or more of conventional developing agents such as dihydroxybenzenes (e.g., hydroquinone), 3-pyrazolidones such as 1-phenyl-3-pyrazolidone and aminophenols such as N-methyl-p-aminophenol. The pH of the color developing solutions and the black and white developing solutions are generally in the range of 9 to 12.

After color development, the photographic materials of the present invention are desilverized. Desilverization comprises basically bleaching and fixing. The desilverization stage may comprise a bleach-fixing stage where bleaching and fixing are simultaneously carried out, or a combination of bleaching and fixing.

Examples of bleaching agents which can be used in bleaching solutions and/or bleach-fixing solutions include the iron(III) complexes of aminopolycarboxylic acids or salts thereof described in JP-A-3-144446 (e.g., the 13th line of right upper column of page 11 to the 4th line of left upper column of page 12) and the iron(III) complexes of organic acids or salts thereof described in JP-A-1-93740, JP-A-3-216650, JP-A-4-22948, JP-A-4-73645, JP-A-4-73647, JP-A-4-127145, JP-A-4-174432, JP-A-134450, JP-A-5-113631, JP-A-5-66527, U.S. Pat. No. 5,217,855, and EP0,520,457A1.

The bleaching agents are used in an amount of preferably 0.01 to 2.0 mol/l, more preferably 0.05 to 1.0 mol/l.

The bleaching solutions and/or the bleach-fixing solutions used in the present invention may contain, in addition to the bleaching agents, rehalogenating agents, pH buffering agents, conventional additives, aminopolycarboxylic acids and organic phosphonic acids described in JP-A-3-144446 (e.g., the 10th line of left upper column to the 19th line of left lower column of page 12).

Beaching accelerators may be added to the beaching solutions and/or the bleach-fixing solutions or the pre-bath thereof in the present invention. Examples of the beaching accelerators which can be used in the present invention include compounds having a mercapto group or a disulfide group described in U.S. Pat. No. 3,893,858, German Patent 1,290,821, U.K. Patent 1,138,842, JP-A-53-95630 and *Research Disclosure* No. 17129 (July 1978), thiazolidine derivatives described in JP-A-50-140129, thiourea derivatives described in U.S. Pat. No. 3,706,561, iodides described in JP-A-58-16235, polyethylene oxides described in German Patent 2,748,430 and polyamine compounds described in JP-B-45-8836. Particularly preferred are mercapto compounds described in U.K. Patent 1,138,842 and JP-A-2-190856.

The bleaching solutions and/or the bleach-fixing solutions may .cóntain, as preservatives, sulfite ion-releasing compounds such as sulfites (e.g. , sodium sulfite, potassium sulfite, ammonium sulfite), bisulfites (e.g., ammonium bisulfite, sodium bisulfite, potassium bisulfite) and metabisulfites (e.g., potassium metabisulfite, sodium metabisulfite, ammonium metabisulfite), hydroxylamines, hydrazines, aldehyde bisulfite adducts (e.g., acetaldehyde sodium bisulfite adduct, particularly preferably compounds described in JP-A-3-158848) and sulfinic acid compounds described in JP-A-1-231051. These compounds are used in an amount of preferably about 0.02 to 0.50 mol/l, more preferably 0.04 to 0.40 mol/l in terms of sulfite ion. Sulfites are generally used as the preservatives. However, ascorbic acid, carbonyl bisulfite adducts or carbonyl compounds may be used. Further, buffering agents, fluorescent brighteners, chelating agents, anti-foaming agents, antifungal agents, etc. may be optionally added. Further, the bleaching solutions and/or the bleach-fixing solutions may contain fluorescent brighteners, anti-foaming agents, surfactants, polyvinyl pyrrolidone and organic solvents such as methanol. It is preferred that the bleaching solutions and/or the bleach-fixing solutions contain chelating agents such as aminopolycarboxylic acids and organic phosphonic acids to stabilize the processing solutions. Preferred examples of the chelating agents include 1-hydroxyethylidene-1,1-diphosphonic acid, ethylenediamine-N,N,N',N'-tetrakis(methylenephosphonic acid), nitrilotrimethylenephosphonic acid, ethylenediaminetetraacetic acid, diethylenetriaminepentaacetic acid, cyclohexanediaminetetraacetic acid and 1,2-propylenediaminetetraacetic acid. Of these compounds, 1-hydroxyethylidene-1,1-diphosphinic acid or ethylenediaminetetraacetic acid is particularly preferred.

Fixing agents which can be used in the bleach-fixing solutions or fixing solutions include conventional fixing agents such as thiosulfates (e.g., sodium thiosulfate, ammonium thiosulfate), thiocyanates (e.g., sodium thiocyanate, ammonium thiocyanate), thioether compounds (e.g., ethylenebisthioglycol, 3,6-dithia-1,8-octanediol), thioureas and water-soluble silver halide solvents (e.g., meso ions). These compounds may be used either alone or as a mixture of two or more of them. Specific bleach-fixing solutions containing a combination of a fixing agent described in JP-A-55-155354 and a large amount of a halide such as potassium iodide can be used. Thiosulfates, particularly ammonium thiosulfate are preferred in the present invention. The fixing agents are used in an amount of preferably 0.3 to 2 mol/l, more preferably 0.5 to 1.0 mol/l. The pH of the bleach-fixing solutions or the fixing solutions is in the range of preferably 3 to 10, particularly 5 to 9.

The bleach-fixing solutions may contain fluorescent brighteners, anti-foaming agents, surfactants, polyvinyl pyrrolidone and organic solvents such as methanol.

Usually, the photographic materials of the present invention are subjected to a rinsing treatment and/or a stabilization treatment after desilverization such as after the fixing stage or the bleach-fixing stage. The amount of rinsing water in the washing stage widely varies-depending on the characteristics (e.g., depending on materials used such as couplers) of the photographic materials, use, the temperature of rinsing water, the number of rinsing tanks (e.g., the number of stages), replenishing system (e.g., countercurrent, direct flow) and other conditions. The relationship between the amount of water and the number of rinsing tanks in the multi-stage countercurrent system can be determined by the method described in *Journal of the Society of Motion Picture Television Engineers*, Vol. 64, pp. 248–253 (May 1955). The number of stages in the multi-stage countercurrent system is preferably 2 to 6, particularly preferably 2 to 4.

According to the multi-stage countercurrent system, the amount of rinsing water can be greatly reduced, for example, to 0.5 to 1 liter per $m^2$ of the photographic material, and the effect of the present invention is remarkable. However, there is a problem such that the residence time of water in the tank is prolonged and as a result, bacteria reproduce and the resulting suspended matter is deposited on the photographic materials. A method for reducing calcium ion and magnesium ion described in JP-A-62-288838 can be very effectively used to solve the above-described problem. Further, isothiazolone compounds and thiabendazole compounds described in JP-A-57-8542, chlorine-containing microbicides such as sodium chlorinated isocyanurate described in JP-A-61-120145, benztriazole and copper ion described in JP-A-61-26761, and microbicides described in *Antimicrobial and Antifungal Chemistry*, written by Hiroshi Horiguchi (published by Sankyo Shuppan) (1966) (written in Japanese), *Sterilization,. Disinfection and Antifungal Technique*, edited by Sanitary Technique Society (1982) (written in Japanese) and *Antimicrobial and Antifungal Encyclopaedia*, edited by Nippon Antimicrobial Antifungal Society (1986) (written in Japanese) can be used.

Rinsing water may contain surfactants as wetting agents and chelating agents, such as EDTA, as water softeners.

The photographic materials can be processed with stabilizing solutions after the rinsing stage, or directly with the stabilizing solutions without conducting the rinsing stage. The stabilizing solutions contain compounds having a function capable of stabilizing images. For example, aldehyde compounds such as formalin, buffering agents for adjusting the pH to a value suitable for stabilizing dyes and ammonium compounds are added to the stabilizing solutions. The above-described microbicides and antifungal agents may be used to prevent bacteria from growing in the stabilizing solutions or to impart antifungal properties to the photographic materials after processing. Further, surfactants, fluorescent brighteners and hardening agents may be used. When the photographic materials of the present invention are directly subjected to the stabilizing treatment without conducting the rinsing stage, all of conventional methods described in JP-A-57-8543, JP-A-58-14834 and JP-A-60-220345 can be used. Further, chelating agents such as 1-hydroxy-ethylidene-1,1-diphosphonic acid and ethylenediaminetetramethylenephosphonic acid, magnesium compounds and bismuth compounds can be preferably used. So-called rinsing solutions can be similarly used as water washing solutions or the stabilizing solutions used after desilverization.

The pH of the rinsing stage or the stabilizing stage is in the range of preferably 4 to 10, more preferably 5 to 8. The temperature varies depending on the use and characteristics of the photographic materials, but is generally 15° to 45° C., preferably 20° to 40° C. The time can be arbitrarily set. However, a shorter time is preferred from the standpoint of reducing the processing time. The time is preferably 15 to 105 seconds, more preferably 30 to 90 seconds.

Generally, formaldehyde is used as the stabilizing agent in the stabilizing solutions for color negative films. Formaldehyde may be used as the stabilizing agent in the present invention as in conventional methods. However, it is preferred from the standpoint of working atmosphere safety that N-methylol pyrazole, hexamethylenetetramine, formaldehyde bisulfite adducts, dimethylol urea and triazole derivatives such as 1,4-bis(1,2,4-triazole-1-ylmethyl)piperazine are used. Particularly, N-methylol pyrazole obtained by the reaction between formaldehyde and pyrazole or a triazole such as 1,2,4-triazole in combination with a derivative thereof such as 1,4-bis(1,2,4-triazole-1-ylmethyl)piperazine (see, JP-A-4-359249) is preferred because image stability is high and formaldehyde vapor pressure is low.

Silver halide emulsions, other materials (additives, etc.), the photographic constituent layers (layer arrangement, etc.), processing methods and processing additives described in JP-A-62-215272, JP-A-2-33144, JP-A-2-139544 and JP-A-2-207250 can be applied to the photographic materials of the present invention.

The present invention is now illustrated in greater detail by reference to the following examples which, however, are not to be construed as limiting the invention in any way.

EXAMPLE 1

Both sides of a paper support were laminated with polyethylene. The surface of the polyethylene-laminated paper support was subjected to a corona discharge treatment. A gelatin subbing layer containing sodium dodecylbenzenesulfonate was then provided thereon. Further, various photographic constituent layers were coated thereon to prepare a multi-layer color photographic paper having the following layer structure (sample 101). Coating solutions were prepared in the following manner.

Preparation of Coating Solution for First Layer 153.0 g of yellow coupler (ExY), 15.0 g of dye image stabilizer (Cpd-1), 7.5 g of dye image stabilizer (Cpd-2) and 16.0 g of dye image stabilizer (Cpd-3) were dissolved in 25 g of solvent (Solv-1), 25 g of solvent (Solv-5) and 180 cc of ethyl acetate. The resulting solution was emulsified and dispersed in 1000 g of a 10% aqueous gelatin solution containing 60 cc of 10% sodium dodecylbenzenesulfonate and 10 g of citric acid to prepare an emulsified dispersion A. Separately, a silver chlorobromide emulsion A (cubic; a 3:7 (by Ag molar ratio) mixture of a larger-size emulsion A having a mean grain size of 0.88 μm and a smaller-size emulsion A having a mean grain size of 0.70 μm; a coefficient of variation in the grain size distribution: 0.08 and 0.10, respectively; 0.3 mol % of silver bromide being localized on a part of the surface of the grain in each size emulsion) was prepared. The following blue-sensitive sensitizing dyes A and B were added to the emulsion ($2.0\times10^{-4}$ mol of each of the sensitizing dyes being added to the larger-size emulsion A, and $2.5\times10^{-4}$ mol of each thereof being added to the smaller-size emulsion A, each amount being per mol of silver). The chemical ripening of the emulsion was carried out by adding a sulfur sensitizing dye and a gold sensitizing dye. The above emulsified dispersion A and the silver chlorobromide emulsion A were mixed and dissolved, and a coating solution for the first layer was prepared so as to give the following composition. The coating weight of the emulsion is represented in terms of silver.

Coating solutions for the second layer through the seventh layer were prepared in the same manner as in the preparation of the coating solution for the first layer. Sodium salt of 1-oxy-3,5-dichloro-s-triazine was used as the hardening agent for gelatin in each layer.

Cpd-14 and Cpd-15 were added to each layer in such an amount as to give the total amounts of 25.0 mg/m$^2$ and 50 mg/m$^2$, respectively.

The following spectral sensitizing dyes were used for the silver chlorobromide emulsion in each light sensitive emulsion layer.

Blue-Sensitive Emulsion Layer

Sensitizing Dye A

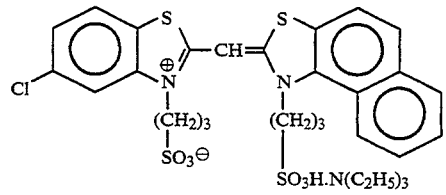

Sensitizing Dye B

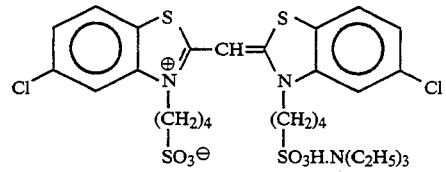

($2.0\times10^{-4}$ mol of each of the above dyes being added to the larger-size emulsion, and $2.5\times10^{-4}$ mol of each thereof being added to the smaller-size emulsion, each amount being per mol of silver halide)

Green-Sensitive Emulsion Layer

Sensitizing Dye C

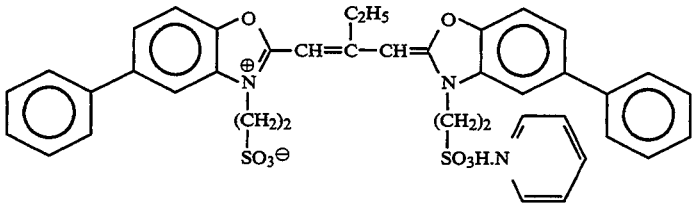

($4.0\times10^{-4}$ mol being added to the larger-size emulsion, and $5.6\times10^{-4}$ mol being added to the smaller-size emulsion, each amount being per mol of silver halide)

Sensitizing Dye D

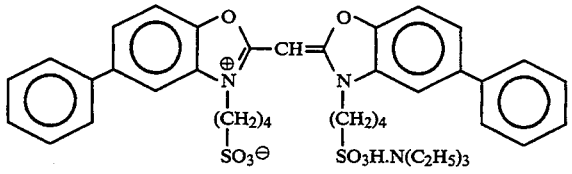

($7.0\times10^{-5}$ mol being added to the larger-size emulsion, and $1.0\times10^{-4}$ mol being added to the smaller-size emulsion, each amount being per mol of silver halide)

Red-Sensitive Emulsion Layer

Sensitizing Dye E

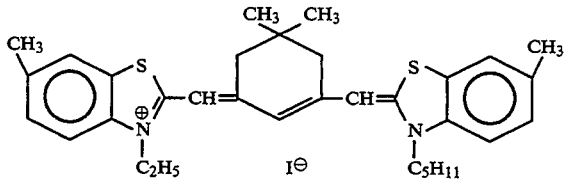

($0.9\times10^{-4}$ mol being added to the larger-size emulsion, and $1.1\times10^{-4}$ mol being added to the smaller-size emulsion, each amount being per mol of silver halide)

Further, $2.6\times10^{-3}$ mol of the following compound F per mol of silver halide was added to the red-sensitive emulsion layer.

Compound F

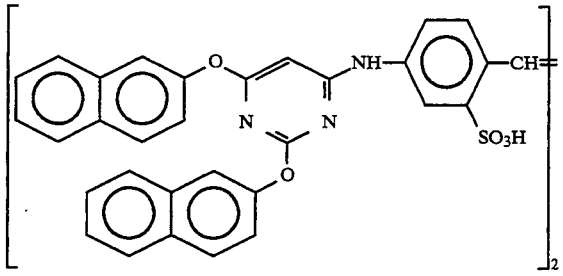

Further, $8.5\times10^{-5}$ mol, $7.7\times10^{-4}$ mol and $2.5\times10^{-4}$ mol of 1-(5-methylureidophenyl)-5-mercaptotetrazole were added to the blue-sensitive emulsion layer, the green-sensitive emulsion layer and the red-sensitive emulsion layer, respectively, each amount being per mol of silver halide.

Furthermore, $1\times10^{-4}$ mol and $2\times10^{-4}$ mol of 4-hydroxy-6-methyl-1,3,3a,7-tetrazaindene were added to the blue-sensitive emulsion layer and the green-sensitive emulsion layer, respectively, each amount being per mol of silver halide.

The following dyes (parenthesized numerals being coating weights) were added to the emulsion layers to prevent irradiation.

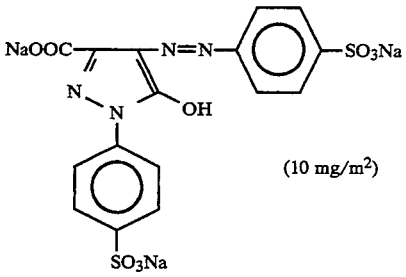

(10 mg/m²)

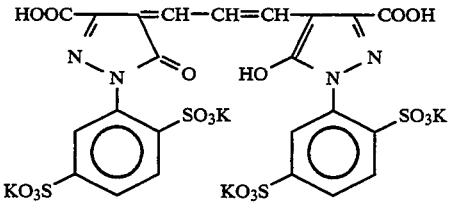

(10 mg/m²)

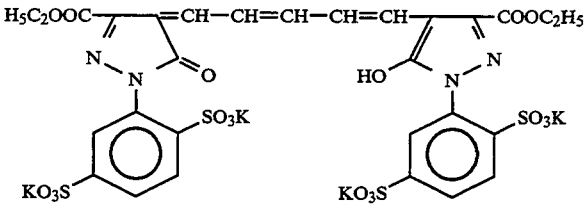

(40 mg/m²)

-continued

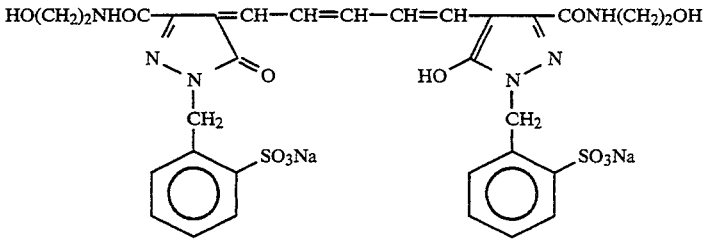

(20 mg/m²)

Layer structure

Each layer had the following composition. Numerals represent coating weight (g/m²). The amounts of the silver halide emulsions are represented by coating weight in terms of silver.

| | |
|---|---|
| Support | |
| Polyethylene-laminated paper [Polyethylene on the first layer side contained white pigment ($TiO_2$) and bluish dye (ultramarine)] | |
| First Layer (blue-sensitive emulsion layer) | |
| The above silver chlorobromide emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second Layer (color mixing inhibiting layer) | |
| Gelatin | 1.00 |
| Color mixing inhibitor (Cpd-4) | 0.04 |
| Solvent (Solv-7) | 0.03 |
| Solvent (Solv-2) | 0.25 |
| Solvent (Solv-3) | 0.25 |
| Third Layer (green-sensitive emulsion layer) | |
| Silver chlorobromide emulsion [cubic; a 1:3 (by Ag molar ratio) mixture of a larger-size emulsion B having a mean grain size of 0.55 μm and a smaller-size emulsion B having a mean grain size of 0.39 μm; a coefficient of variation in the grain size distribution: 0.10 and 0.08, respectively; 0.8 mol % of AgBr being localized on a part of the surface of the grain in each size emulsion] | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (red-sensitive emulsion layer) | |
| Silver chlorobromide emulsion [cubic; a 1:3 (by Ag molar ratio) mixture of a larger-size emulsion C having a mean grain size of 0.50 μm and a smaller-size emulsion C having a mean grain size of 0.41 μm; a coefficient of variation in the grain size distribution: 0.09 and 0.11, respectively; 0.8 mol % of AgBr being localized on a part of the surface of the grain in each size emulsion] | 0.20 |
| Gelatin | 0.85 |
| Cyan coupler (ExC) | 0.33 |
| Ultraviolet light absorber (UV-2) | 0.18 |
| Dye image stabilizer (Cpd-1) | 0.33 |
| Dye image stabilizer (Cpd-9) | 0.02 |
| Dye image stabilizer (Cpd-10) | 0.02 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Sixth Layer (ultraviolet light absorbing layer) | |
| Gelatin | 0.55 |
| Ultraviolet light absorber (UV-1) | 0.38 |
| Dye image stabilizer (Cpd-12) | 0.15 |
| Dye image stabilizer (Cpd-5) | 0.02 |
| Seventh Layer (protective layer) | |
| Gelatin | 1.13 |
| Acrylic-modified copolymer of polyvinyl alcohol (a degree of modification: 17%) | 0.05 |
| Liquid paraffin | 0.02 |
| Dye image stabilizer (Cpd-13) | 0.01 |

(ExY) Yellow Coupler

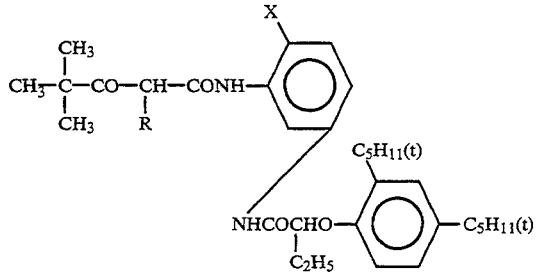

1:1 mixture (by mol) of

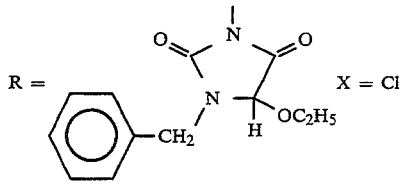

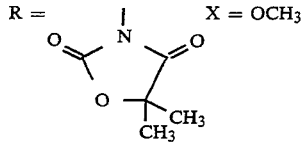

(ExM) Magenta Coupler

-continued

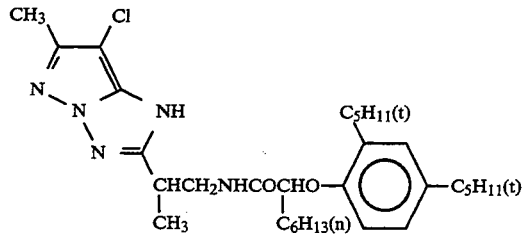

(ExC) Cyan Coupler:
3:7 mixture (by mol)

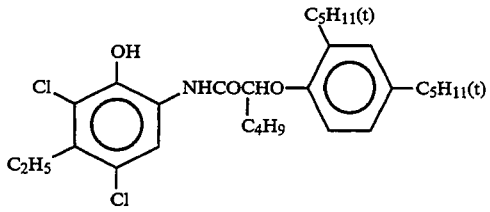

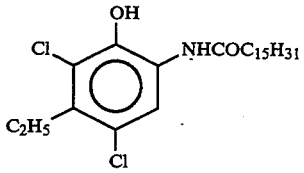

(Cpd-1) Dye Image Stabilizer

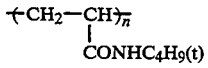

(Average MW 60,000)
(Cpd-2) Dye Image Stabilizer

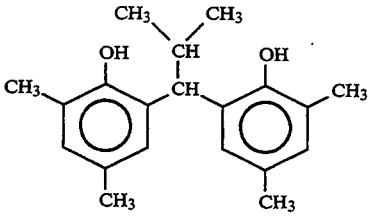

(Cpd-3) Dye Image Stabilizer

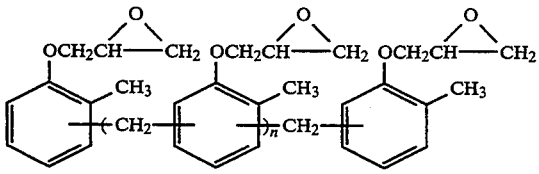

n = 7 to 8 (mean value)
(Cpd-4) Dye Image Stabilizer

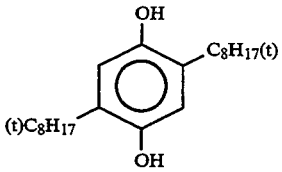

(Cpd-5) Dye Image Stabilizer

-continued

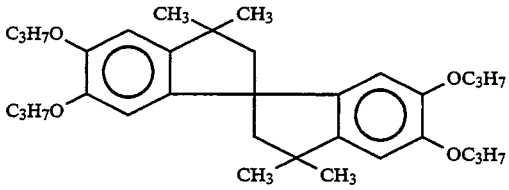

(Cpd-6) Dye Image Stabilizer

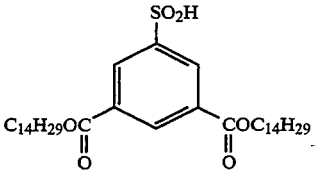

(Cpd-7) Dye Image Stabilizer

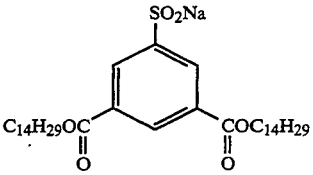

(Cpd-8) Dye Image Stabilizer

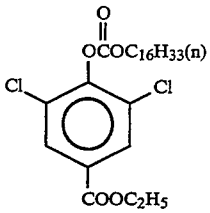

(Cpd-9) Dye Image Stabilizer

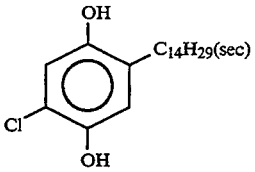

(Cpd-10) Dye Image Stabilizer

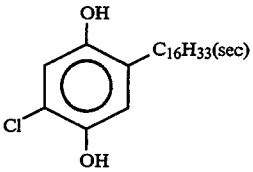

(Cpd-11) Dye Image Stabilizer

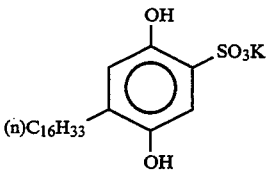

(Cpd-12) Dye Image Stabilizer

-continued
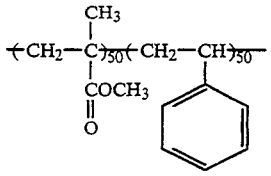
Average MW 60,000
(Cpd-13) Dye Image Stabilizer
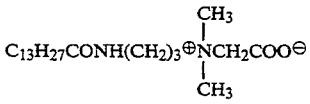
(Cpd-14) Antiseptic
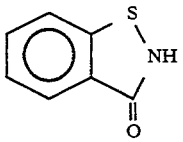
(Cpd-15) Antiseptic
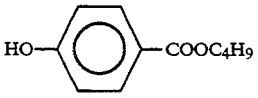
(Solv-1) Solvent
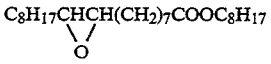
(Solv-2) Solvent
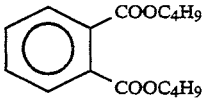
(Solv-3) Solvent
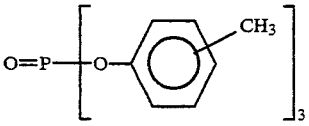
(Solv-4) Solvent
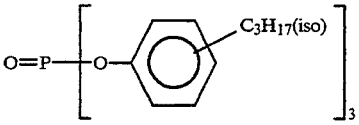
(Solv-5) Solvent
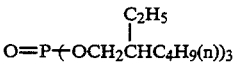
(Solv-6) Solvent
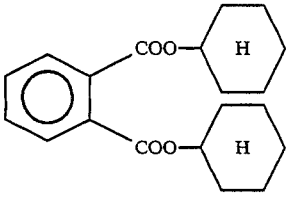
(Solv-7) Solvent
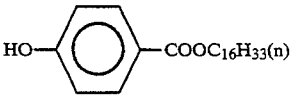
(UV-1) Ultraviolet Light Absorber
1:5:10:5 mixture (by weight) of
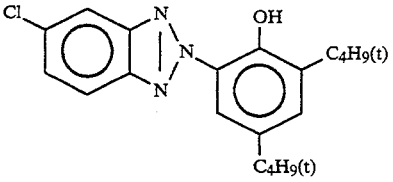
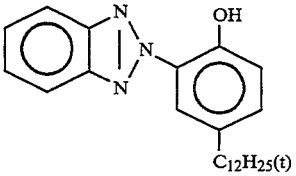
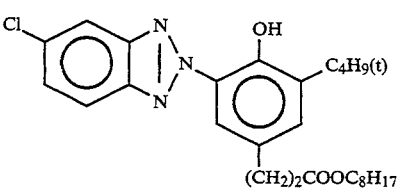
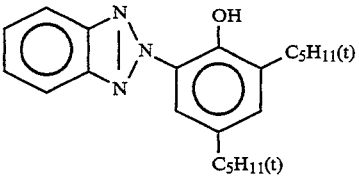
(UV-2) Ultraviolet Light Absorber
1:2:2 mixture (by weight) of
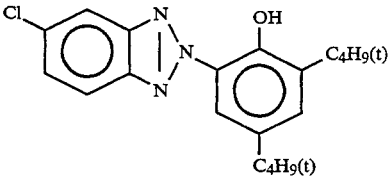
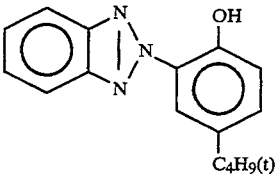

-continued

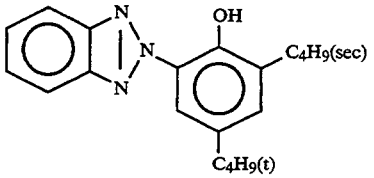

Samples 102 to 110 were prepared in the same manner as in the preparation of sample 101 except that an equimolar amount of the compound shown in Table 1 below was used in place of the color mixing inhibitor (Cpd-4) used in each of the second layer and the fourth layer of sample 101.

The thus-prepared samples were imagewise exposed to blue color light.

The exposed samples were subjected to continuous processing by using a paper processor in the following processing stages using the following processing solutions until the color developing solution reached twice the tank capacity to prepare a processing solution in the running equilibrium state.

| Processing Stage | Temp. | Time | Replenisher* | Tank Capacity |
|---|---|---|---|---|
| Color development | 35° C. | 45 sec | 101 ml | 17 l |
| Bleach-Fixing | 30–35° C. | 45 sec | 215 ml | 17 l |
| Rinse (1) | 30–35° C. | 20 sec | — | 10 l |
| Rinse (2) | 30–35° C. | 20 sec | — | 10 l |
| Rinse (3) | 30–35° C. | 20 sec | 350 ml | 10 l |
| Drying | 70–80° C. | 60 sec | | |

*Replenishment rate being per $m^2$ of the photographic material
Rinse was a three tank countercurrent system of from (3) to (2) and from (2) to (1).

The processing solutions had the following compositions.

| | Tank Solution | Replenisher |
|---|---|---|
| Color Developing Solution | | |
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)-hydrazine | 4.0 g | 5.0 g |
| N,N-Di(sulfoethyl)hydroxylamine Monosodium Salt | 4.0 g | 5.0 g |
| Fluorescent Brightener (WHITEX 4B manufactured by Sumitomo Chemical Co., Ltd.) | 1.0 g | 2.0 g |
| Water to make | 1000 ml | 1000 ml |
| pH (25° C.) | 10.05 | 10.45 |

Bleach-Fixing Solution

Tank solution and replenisher being the same.

| | |
|---|---|
| Water | 400 ml |
| Ammonium Thiosulfate (700 g/l) | 100 ml |
| Sodium Sulfite | 17 g |
| Ammonium Ethylenediaminetetraacetato Ferrate Dihydrate | 55 g |
| Disodium Ethylenediaminetetraacetate Dihydrate | 5 g |
| Ammonium Bromide | 40 g |
| Water to make | 1000 ml |
| pH (25° C.) | 6.0 |

Rinsing Solution

Tank solution and replenisher being the same.

Ion-exchanged water (the concentration of each of calcium ion and magnesium ion was reduced to 3 ppm or below).

The density of each of the processed samples was measured by a blue filter (central wavelength: 440 nm) and a green filter (central wavelength: 545 nm). A value obtained by subtracting the fog density (including the sub-absorption of yellow dye) of magenta from the magenta density in an exposure amount providing a yellow density of (fog+1.5) is referred to as color mixing level. The results obtained are shown in Table 1 below. Separately, the samples were exposed to green light, and subjected to the same color development as described above. The samples were allowed to stand at 80° C. and 70% RH for one week, and then continuously irradiated with a xenon lamp of 85000 1× for 4 weeks. Immediately after processing, a lowering in the density from the magenta density=1.0 was measured. The value of the lowering is referred to as magenta fading. The results obtained are also shown in Table 1 below.

TABLE 1

| Sample | Color Mixing Inhibitor | Color Mixing Level | Magenta Fading | Remarks |
|---|---|---|---|---|
| 001 | Cpd-4 | 0.05 | 0.25 | Com. Ex. |
| 002 | HQ-1 | 0.05 | 0.22 | " |
| 003 | HQ-2 | 0.04 | 0.17 | " |
| 004 | HQ-3 | 0.04 | 0.15 | " |
| 005 | HQ-4 | 0.05 | 0.26 | " |
| 006 | (I-1) | 0.01 | 0.05 | Invention |
| 007 | (I-2) | 0.01 | 0.06 | " |
| 008 | (I-6) | 0.02 | 0.09 | " |
| 009 | (I-7) | 0.01 | 0.08 | " |
| 010 | (I-12) | 0.02 | 0.10 | " |
| 011 | (I-25) | 0.02 | 0.10 | " |
| 012 | (II-1) | 0.01 | 0.04 | " |
| 013 | (II-2) | 0.01 | 0.05 | " |
| 014 | (II-10) | 0.02 | 0.08 | " |
| 015 | (II-16) | 0.02 | 0.09 | " |
| 016 | (II-25) | 0.01 | 0.07 | " |
| 017 | (II-30) | 0.02 | 0.10 | " |

HQ-1

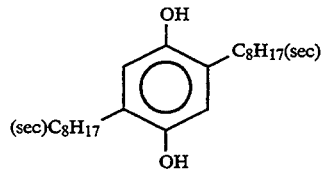

HQ-2

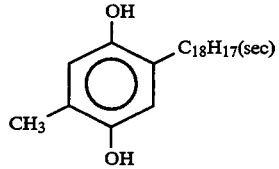

HQ-3

TABLE 1-continued

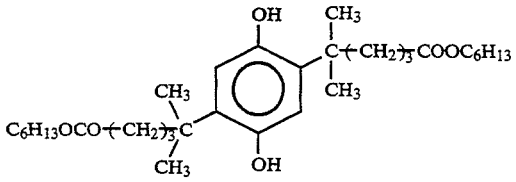

HQ-4

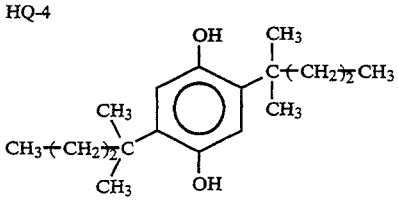

It can be seen from Table 1 that samples 105 to 110 obtained by using the compounds of the present invention are excellent in color mixing inhibiting performance as well as in preservability in comparison with the comparative samples.

EXAMPLE 2

The same sample 201 as sample 101 of Example 1 of JP-A-3-223752 was prepared. Samples 202 to 205 were prepared in the same manner as in the preparation of sample 201 except that an equimolar amount of each of the compounds I-1, I-6, I-8 and II-1 of the present invention was used in place of the compound (Cpd-2) used in each of the 11th layer and the 12th layer of sample 201.

The samples were imagewise exposed to light and subjected to color development under the same conditions as described in Example 1 of JP-A-3-223752. After processing, the yellow fog density of each sample was measured. It was found that the fog density of each of the samples 202 to 205 was clearly low in comparison with the sample201.

EXAMPLE 3

The same sample 301 as the light-sensitive sheet A of Example 1 of JP-A-1-154151 was prepared. Samples 302 to 307 were prepared in the same manner as in the preparation of sample 301 except that an equimolar amount of each of the compounds I-1, I-11, I-18, II-1, II-5 and II-20 of the present invention was used in place of 2,5-di-t-pentadecylhydroquinone used in each of the first, fourth and seventh layers of sample 301.

These samples were imagewise exposed to light and processed in the same manner as in Example 1 of JP-A-1-154151. After processing, the preservability of the samples was evaluated in the same manner as in Example 1. It was found that the preservability of the samples 302 to 307 was clearly superior in comparison with sample 301.

EXAMPLE 4

The same sample 401 as sample 301 of Example 4 of JP-A-1-154151 was prepared. Samples 402 to 407 were prepared in the same manner as in the preparation of sample 401 except that an equimolar amount of each of the compounds I-1, I-9, I-25, II-1, II-6 and II-28 was used in place of compound I-12 used in each of the second, eighth, 13th and 17th layers of sample 401.

The samples were imagewise exposed to light and processed in the same manner as in Example 4 of JP-A-1-154151. After processing, the preservability of the samples was evaluated in the same manner as in Example 1. It was found that the preservability of the samples 402 to 407 was clearly superior in comparison with sample 401.

It will be understood from the above disclosure that according to the present invention, the color mixing of the silver halide color photographic material can be prevented from occurring, and the preservability of the color photographic materials can be improved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one layer containing at least one member of compounds selected from the group consisting of compounds represented by the following general formula (1) and (2):

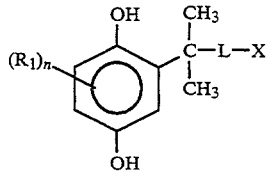

(1)

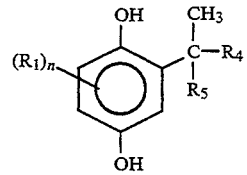

(2)

wherein L represents an unsubstituted alkylene group; X represents —O(C=O)$R_2$ or —O(P=O)($R_2$)($R_3$); $R_1$ represents a substituent group; $R_2$ and $R_3$ each represents a substituted or unsubstituted alkoxy group, a substituted or unsubstituted aryloxy group or a substituted or unsubstituted amino group; n represents 0, 1 or 2 and when n is 2, two $R_1$ groups may be the same or different; $R_4$ represents an unsubstituted alkyl group having 4 to 8 carbon atoms; and $R_5$ represents an unsubstituted alkyl group, the number of carbon atoms of which is larger by 2 than the number of carbon atoms of $R_4$.

2. The silver halide photographic material according to claim 1, wherein the substituent group represented by $R_1$ is a cyano group, a nitro group, a hydroxy group, a carboxyl group, a sulfo group, an alkyl group, an alkoxy group, an aryloxy group, an alkylthio group, an arylthio group, an acylamino group, a sulfonamido group, a ureido group, a heterocyclic thio group, an acyl group, a sulfonyl group, —O(C=O)$R_2$, —O(P=O)($R_2$)($R_3$) or a halogen atom, wherein $R_2$ and $R_3$ are defined above.

3. The silver halide photographic material according to claim 2, wherein $R_1$ is a halogen atom, a sulfo group, an alkyl group, an acylamino group or a sulfonamido group.

4. The silver halide photographic material according to claim 1, wherein n is 1.

5. The silver halide photographic material according to claim 1, wherein X represents —O(C=O)$R_2$, wherein $R_2$ is defined above.

6. The silver halide photographic material according to claim 1, wherein $R_2$ and $R_3$ each represents a substituted or unsubstituted alkoxy group having 1 to 20 carbon atoms, a substituted or unsubstituted aryloxy group having 6 to 20 carbon atoms, or a substituted or unsubstituted amino group having 0 to 20 carbon atoms.

7. The silver halide photographic material according to claim 1, wherein the compounds of general formula (1) or (2) are represented by the following general formula (1a) or (2a):

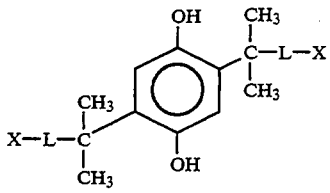

(1a)

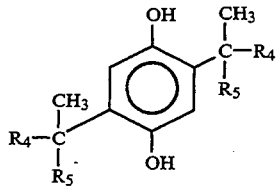

(2a)

wherein L, X, $R_4$ and $R_5$ are defined in general formulas (1) and (2).

8. The silver halide photographic material according to claim 1, wherein said silver halide photographic material comprises on the support at least one silver halide emulsion layer and interlayer adjacent thereto, and said compounds are added to at least one of said silver halide emulsion layer and an interlayer adjacent thereto.

9. The silver halide photographic material according to claim 1, wherein the compounds are present in an amount of $1\times10^{-8}$ to $1\times10^{-2}$ mol/m$^2$.

10. The silver halide photographic material according to claim 1, wherein L is selected from the group consisting of ethylene, butylene, hexylene, and propylene.

11. The silver halide photographic material according to claim 1, wherein the substituent group represented by $R_1$ is an alkyl group having 1 to 40 carbon atoms, an alkoxy group having 1 to 40 carbon atoms, an aryloxy group having 6 to 40 carbon atoms, an alkylthio group having 1 to 40 carbon atoms, an arylthio group having 6 to 40 carbon atoms, an alkyl, aryl or heterocyclic acylamino group having 2 to 40 carbon atoms, an alkyl, aryl or heterocyclic sulfonamido group having 1 to 40 carbon atoms, a ureido group having 0 to 40 carbon atoms, a heterocyclic thio group having 1 to 40 carbon atoms, an alkyl, aryl or heterocyclic acyl group having 2 to 40 carbon atoms, an alkyl, aryl or heterocyclic sulfonyl group having 1 to 40 carbon atoms.

12. The silver halide photographic material according to claim 1, wherein the alkyl group represented by $R_4$ is selected from the group consisting of a butyl group, a hexyl group, an octyl group, and an 1,3,3-trimethylbutyl group.

13. The silver halide photographic material according to claim 8, wherein said compounds are added to at least one interlayer adjacent to said at least one silver halide emulsion layer.

14. The silver halide photographic material according to claim 1, wherein said material comprises a compound of general formula (1).

15. The silver halide photographic material according to claim 1, wherein said material comprises a compound of general formula (2).

16. A silver halide photographic material comprising a support having thereon at least one layer containing at least one member of compounds selected from the group consisting of compounds represented by the following general formula (1) and (2):

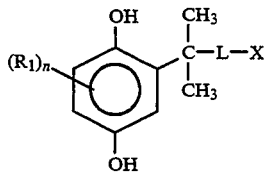

(1)

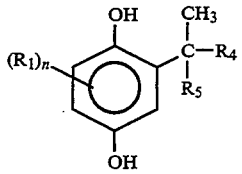

(2)

wherein L represents an unsubstituted alkylene group having 1 to 20 carbon atoms; X represents —O(C=O)$R_2$ or —O(P=O)($R_2$)($R_3$); $R_1$ represents a substituent group; $R_2$ and $R_3$ each represents a substituted or unsubstituted alkoxy group, a substituted or unsubstituted aryloxy group or a substituted or unsubstituted amino group; n represents 0, 1 or 2 and when n is 2, two $R_1$ groups may be the same or different; $R_4$ represents an unsubstituted alkyl group having 4 to 8 carbon atoms; and $R_5$ represents an unsubstituted alkyl group, the number of carbon atoms of which is larger by 2 than the number of carbon atoms of $R_4$.

* * * * *